US005287693A

United States Patent [19]

Stahlecker

[11] Patent Number: 5,287,693

[45] Date of Patent: Feb. 22, 1994

[54] SPINNING MACHINE HAVING SLIVERS EXPOSED ON A TRANSPORT BELT TO AIR-CONDITIONED AIR

[75] Inventor: Gerd Stahlecker, Eislingen/Fils, Fed. Rep. of Germany

[73] Assignees: Fritz Stahlecker; Hans Stahlecker, both of Fed. Rep. of Germany

[21] Appl. No.: 870,958

[22] Filed: Apr. 20, 1992

[30] Foreign Application Priority Data

Jul. 16, 1991 [DE] Fed. Rep. of Germany ..... 4123451

[51] Int. Cl.[5] ..... D01H 13/04

[52] U.S. Cl. ..... 57/308; 57/90

[58] Field of Search ..... 57/308, 90, 315

[56] References Cited

U.S. PATENT DOCUMENTS 3,073,106 1/1963 Tsuzuki ..... 57/308
3,312,050 4/1967 Noguera ..... 57/90
3,564,829 2/1971 Tsuzuki ..... 57/308
4,022,007 5/1977 Motobayashi et al. ..... 57/308 X
4,055,937 11/1977 Latus et al. ..... 57/308

FOREIGN PATENT DOCUMENTS 2544643 4/1977 Fed. Rep. of Germany .
3919284 12/1990 Fed. Rep. of Germany .
1015780 1/1966 United Kingdom .
1183208 3/1970 United Kingdom .

*Primary Examiner*—Joseph J. Hail, III
*Attorney, Agent, or Firm*—Evenson, McKeown, Edwards & Lenahan

[57] ABSTRACT

In the case of a spinning machine with several spinning stations for the spinning of sliver which is guided by transport devices from cans to the spinning stations, devices are provided for the air-conditioning of the slivers during the transport from the cans to the spinning stations. The air-conditioning devices include air-conditioning ducts which extend adjacent a portion of the travel path of the slivers.

20 Claims, 8 Drawing Sheets

A'
6'
5'
4'
B'
7'
19'
C'
3'
2'
D'
18
1
10
C
19
3
D
9
11
22
2
14
7
4
B
12
5
13
15
17
20
6
16
8
A

A'
6B'
5B'
7B'
B'
4'
2B'
3B'
C'
D'
18B
27B
30B
10B
1
D
C
29B
3B
9B
11B
2B
14B
7B
B
4
15B
5B
13B
17B
16B
6B
8B
A

6D'
A'
5D'
B'
7D'
4'
2D'
3D'
C'
D'
18D
1
34D
E'
35D
E
36D
10D
C
D
9D
11D
3D
2D
7D
4
14D
B
5D
13D
15D
17D
16D
A
8D
6D

6G'
5G'
40G'
7G'
4'
3G'
2G'
18G
1
11G
3G
2G
9G
10G
40G
7G
4
14G
5G
13G
15G
17G
41G
8G
16G
6G

SPINNING MACHINE HAVING SLIVERS EXPOSED ON A TRANSPORT BELT TO AIR-CONDITIONED AIR

BACKGROUND AND SUMMARY OF THE INVENTION

This invention relates to a spinning machine comprising several spinning stations, depositing sites for cans containing sliver and transport devices which contain transport belts for the transporting of the slivers from the cans to the spinning stations.

In the case of a known spinning machine of the initially mentioned type (British Patent Document GB 10 15 780), two transport belts are provided which extend in parallel to one another and in each case receive a sliver between one another and transport the sliver from the cans to the drafting units of the spinning machine.

It is also known (British Patent Document GB 11 83 208) to deposit the cans above the spinning machine on another floor and to transport the slivers through tubes downward to the spinning stations, in which case the slivers are to move downward in the tubes because of their own weight. In this construction, it is provided to guide the tubes, which in this area are provided with a perforation or the like, through an air-conditioning duct which contains air with an air humidity that is maintained at a given value. As a result, the slivers are to be brought into a condition that is advantageous for spinning, particularly with respect to their humidity content.

In the case of an open-end spinning machine (German Patent Document DE-A 39 19 284), it is known to deposit the cans containing the sliver to be spun on an air-conditioning duct which supplies air-conditioned air into the cans. As an alternative, an air-conditioning duct by which air-conditioned air is supplied into the cans may be arranged in the interior of the machine.

In the case of double twist frames (German Patent Document DE-B 25 44 643), it is known to provide an air-conditioning duct extending in the longitudinal direction of the machine from which air-conditioned air is blown through blow nozzles on each spindle into the upper area of a yarn balloon. The air-conditioned air also sweeps over the feeding packages.

It is an object of the invention to provide a spinning machine of the initially mentioned type which is able to directly process fine slivers, particularly in the size range of Nm 0.3 to Nm 0.8 and still maintain favorable spinning conditions.

This object is achieved according to preferred embodiments of the invention in that devices are provided for admitting air-conditioned air to the slivers on their path between the cans and the spinning stations.

By means of the transport belts, such fine slivers can easily be transported without the danger that the slivers may be drafted unintentionally during the transport. The air-conditioning of the slivers on the path from the cans to the spinning stations has the advantage that good working conditions are created particularly with respect to the humidity content of the slivers. In this case, it is not required that the whole area of the spinning machine be air-conditioned which, as a rule, would lead to very high expenditures and a very high consumption of energy.

In the case of a first embodiment of the invention, at least one air-conditioning duct is provided which extends in the longitudinal direction of the machine and through which the slivers pass either alone or together with pertaining transport belts. Since, on the one hand, the transport speed of the slivers is relatively low, that is, in the order of from 0.06 to 0.16 m/min (meters/minute), a relatively short path is sufficient in order to achieve a sufficient air-conditioning of the slivers. Since, with the exception of the inlet openings for the slivers, the air-conditioning duct can be sealed off by means of the transport belts, the energy consumption is relatively low.

In the case of another development of the invention, an air-conditioning duct is provided which extends in the longitudinal direction of the machine and is provided with air outlet openings aimed at the slivers situated on the transport belts. The air-conditioned air flowing out of the air-conditioning unit will then flow against the slivers.

In a further development of the invention, a suction duct, which extends in the longitudinal direction of the machine is expediently provided for the intake of the air delivered by the air-conditioning duct. As a result, the energy consumption can be reduced because the taken-in air can repreprocessed and again fed to the air-conditioning duct. The energy consumption will then be lower than when the air-conditioning duct must process room air.

In a further development of the invention, it is provided that the transport belts are arranged at least partially inside air ducts which are open in the direction of the depositing sites of the cans and the spinning stations and to which the air outlet openings of the air-conditioning duct or ducts are connected. As a result, the air flowing out of the air-conditioning duct or ducts can be guided in the solely required area, whereby a concentrated take-in then also becomes possible.

In order to, on the one hand, securely guide and transport the fine slivers at expenditures that are as low as possible and in order to, on the other hand, permit an access of the air-conditioned air to them, sliding guides are provided in another development of the invention for the holding of the slivers on the transport belts, in which case the sliding guides and/or the transport belts are constructed to be at least partly air-permeable by means of perforations or the like.

In a particularly simple embodiment of the invention, sliding guides are assigned to the transport belts which are provided at least at one point with a chamber-type widening which can be supplied with air-conditioned air. Thus, the sliding guides are provided with the additional function of a climatic chamber.

Other objects, advantages and novel features of the present invention will become apparent from the following detailed description of the invention when considered in conjunction with the accompanying drawings.

DETAILED DESCRIPTION OF THE DRAWINGS

Figure 1:
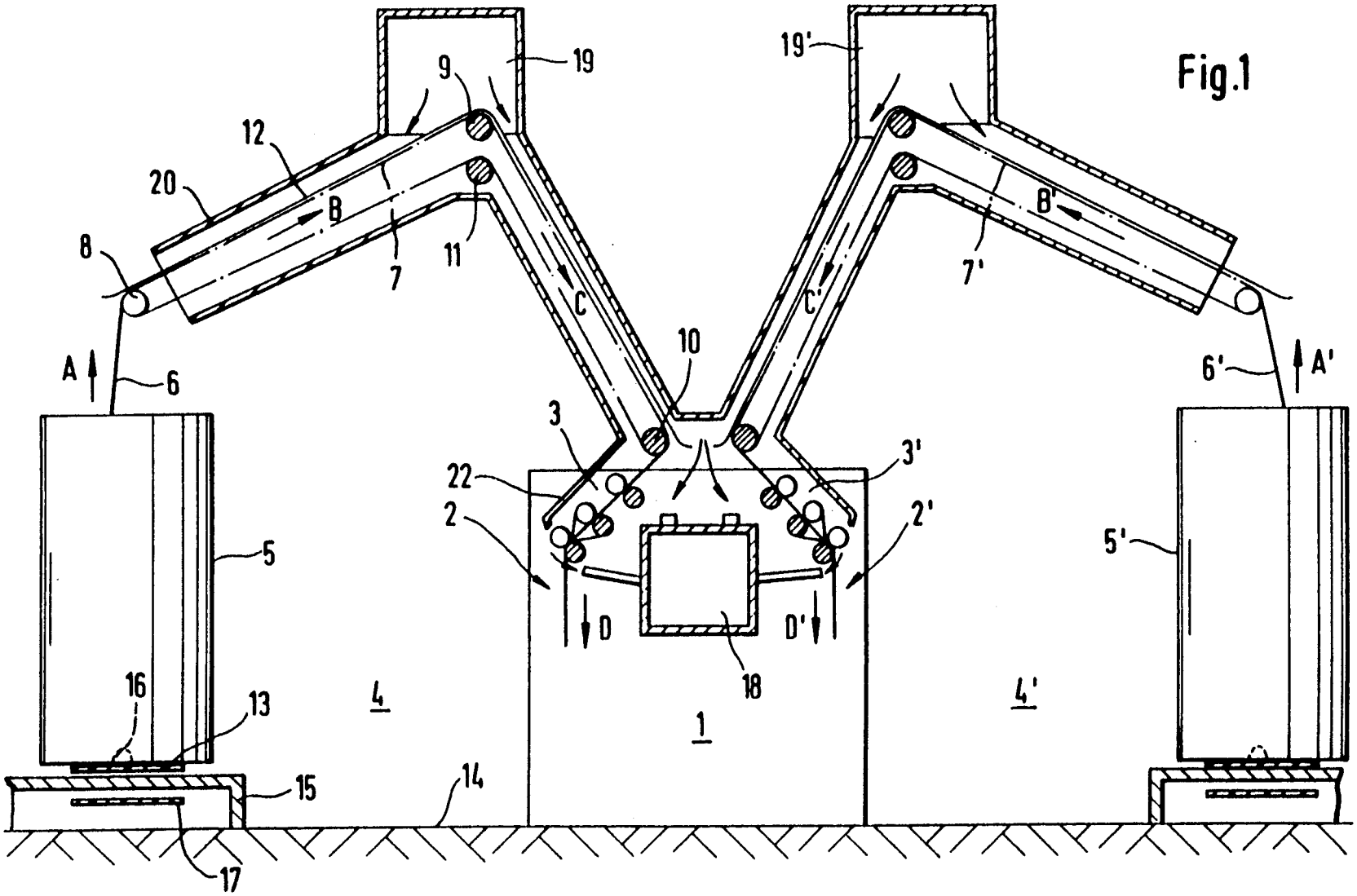
FIG. 1 is a partial cross-sectional view of a spinning machine according to the invention having two air-conditioning ducts extending in the longitudinal direction of the machine to which the air ducts are connected which receive the transport devices.

The basic shape of the spinning machine 1 is the same for all embodiments so that it will only be described by means of FIG. 1. The spinning machine 1, which may, for example, be a ring spinning machine, is shown only schematically. On both sides of the machine, it has a plurality of spinning stations 2, 2' arranged in a row next to one another which each have a drafting unit 3, 3'. The drafting units 3, 3' are constructed as conventional three-cylinder drafting units. They draft slivers 6, 6' to a desired yarn size which subsequently travel in the direction of the arrow D, D' to a twist-providing element, particularly to a ring spindle. Slivers 6, 6' are spun which are relatively fine; that is, of a size from approximately Nm 0.3 to Nm 0.8. As a result, it is possible to draft the slivers 6, 6' sufficiently while nevertheless the feeding roller pairs of the drafting units 3, 3' still rotate at a sufficiently high rotational speed which ensures a perfect concentricity in the case of a long spinning machine.

The fine slivers 6, 6' are fed in cans 5, 5' which are deposited next to the spinning machine 1 while leaving an operating aisle 4, 4'. Since, as a rule, the cans 5, 5' have a diameter which is larger than the distance between two adjacent spinning stations 2, 2' of one side of the machine, these cans 5, 5' are deposited in several rows in a manner not shown in detail. In order not to expose the fine slivers 6, 6' to any faulty drafts and be able to take them out of the cans 5, 5 and transport them to the drafting units 3, 3', transport devices are provided. These transport devices comprise transport belts 7, 7' which are guided from the area above the cans 5, 5' diagonally upward over the operating aisles 4, 4' and then downward again to the drafting units 3, 3'. The transport belts 7, 7' each run around four deflecting rollers 8, 9, 10, 11 which guide the transport belts 7, 7' along an angular course. The deflecting roller 8 which in each case is situated above the cans 5, 5' is constructed as a tension roller. The deflecting roller 10 situated in the feeding area of the drafting units 3, 3' is constructed as a driving roller. The deflecting rollers 9, 10, 11 are expediently constructed as shafts or axles extending through in the longitudinal direction of the machine. In order to hold the slivers 6, 6' securely on the transport belts 7, 7', sliding guides are assigned to these transport belts 7, 7' in such a manner that the slivers 6, 6' lying on the transport belts 7, 7' are covered and are preferably also held with a slight pressure against the transport belts 7, 7'. In the illustrated embodiment, these sliding guides are constructed as skids 12. The slivers 6, 6' are therefore transported in the direction of the arrow (A) essentially vertically upward; then, in the direction of the arrow (B), first diagonally over the operating aisle 4,4'; and then subsequently in the direction of the arrows (C, C') diagonally downward to the drafting units 3, 3'.

The cans 5, 5' stand on transport belts 13 which are a component of a platform 15 which is elevated slightly with respect to the floor 14. The transport belts 13, which run in the longitudinal direction of the machine, slide on the top side of the platform 15. The returning run 17 will then run back inside the platform 15. The transport belts 13 are provided with button-type take-along devices 16 which reach behind the inner lower edge of the cans 5, 5' which are normally provided with a bottom that is offset slightly upward with respect to the lower edge. By means of the transport belts 13, an automatic can exchange may be carried out in which case the take-along devices provide that also the then newly fed cans are deposited in the correct position.

The slivers 6, 6' are transported from the cans 5, 5' to the drafting units 3,3' at a relatively slow speed. As a function of the size of the slivers 6, 6' and as a function of the size of the spun yarn, this speed is in the order of from 0.06 m/min to approximately 0.16 m/min. The slivers 6, 6' therefore stay on the transport devices for a relatively long time. According to the present invention this is utilized for the purpose of air-conditioning these slivers 6, 6'; that is, these slivers mainly are provided with the humidity content that is optimal for the spinning.

In the embodiment according to FIG. 1, two air-conditioning ducts 19, 19' are provided which extend in the longitudinal direction of the machine and which are arranged approximately in the center above the respective transport belts 7, 7'. The transport belts 7, 7' and the sliding guides 12 are arranged inside an air duct 20 which extends preferably along one machine section and in the process envelopes the transport belts 7, 7' which are part of this section. The air-conditioning ducts 19 are provided with air outlet openings which are open in the direction of the air duct 20. It is preferably provided that, in the area of the inlet of the transport belts 7, 7', that is, in the area of the deflecting roller 8, the air ducts 20 are sealed off as much as possible so that the supplied air-conditioned air does not escape from this area. This air-conditioned air is to flow to the area of the drafting units 3, 3' which is covered by a covering 22 connected to the air ducts 20. In the area between the drafting units 3, 3', an intake duct 18 is arranged which extends through in the longitudinal direction of the machine and which takes in the arriving air-conditioned air and returns it to the air-conditioning system of the air-conditioning ducts 19, 19'. This air-conditioning system expediently comprises an air humidifier.

In the embodiments of FIGS. 2–8, correspondingly functioning features have similar drawing reference characters, but with a letter suffix (A, B, etc.) added to designate the different embodiments. To the extent that these features are different than in the FIG. 1 embodiment, the following description will set forth these differences. Otherwise reference to the description of FIG. 1 should be made as needed for an understanding of these embodiments.

Figure 2:
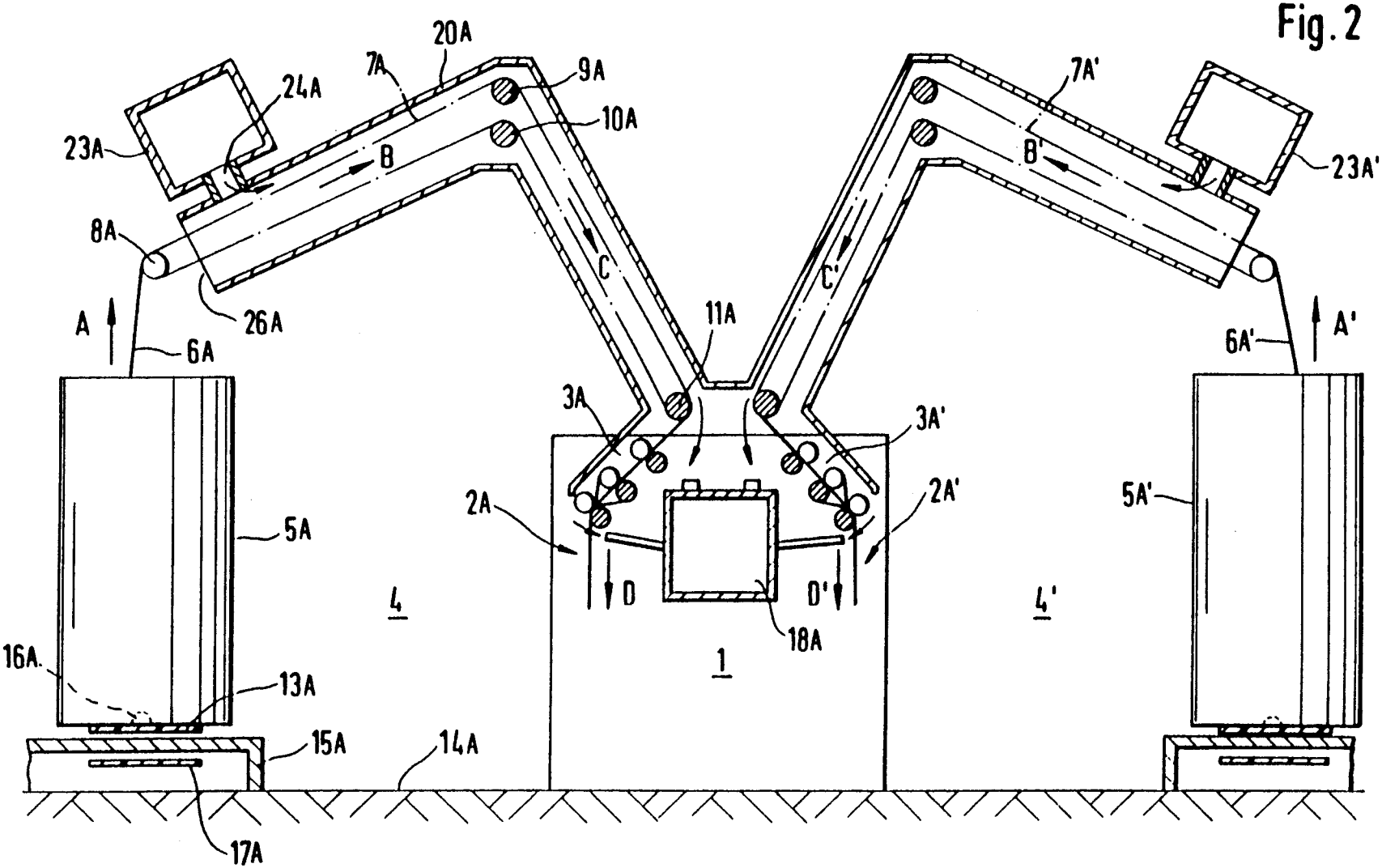
FIG. 2 is a partial cross-sectional view similar to FIG. 1, in which case the air-conditioning ducts are connected to the area of the air ducts which starts above the depositing sites of the cans.

The embodiment according to FIG. 2 corresponds largely to the embodiment according to FIG. 1 but two air-conditioning ducts 23A, 23A' which extend in the longitudinal direction of the machine are connected to the air ducts 20A in the inlet area of the air ducts 20A. Since, also in the case of this embodiment, the air-conditioned air, which is fed to the air ducts 20A by way of the air outlet openings 24A, if possible, is to flow to the area of the drafting units 3A, 3A', it is provided in this embodiment that the air outlet opening 24A already has a corresponding outflow direction in the transport direction (B). In the case of this embodiment, it is particularly expedient for the inlet area 26A to be sealed off as extensively as possible.

Figure 3:
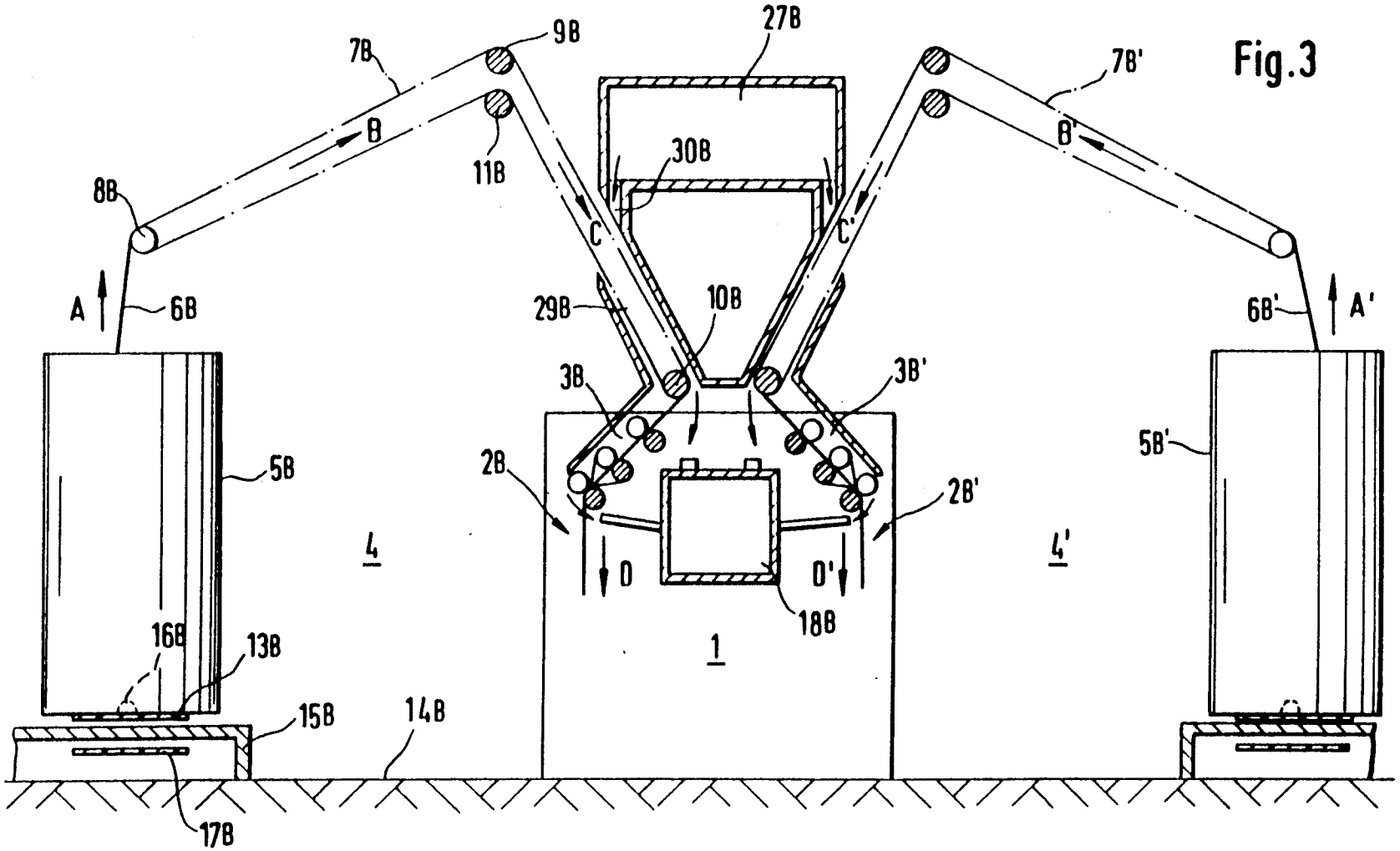
FIG. 3 is a partial cross-sectional view of a spinning machine according to the invention which has a central air-conditioning duct to which short air ducts are connected in the area of the machine center.

In the case of the embodiment according to FIG. 3, a single air-conditioning duct 27B is provided which is arranged in the area above the machine center and which is assigned to the transport devices of both sides of the machine. The transport belts 7B, 7B' are surrounded only in their end area just in front of the drafting units 3B, 3B' by the air ducts 29B toward which the air-conditioning duct 27B is open by means of the air outlet openings 30B. Because of the slow transport speed of the slivers 6B, 6B', a sufficient air conditioning of these slivers 6B, 6B' is ensured also in the case of this embodiment. In this embodiment, the air-conditioned air is also taken in by means of a central take-in device 18B.

Figure 4:
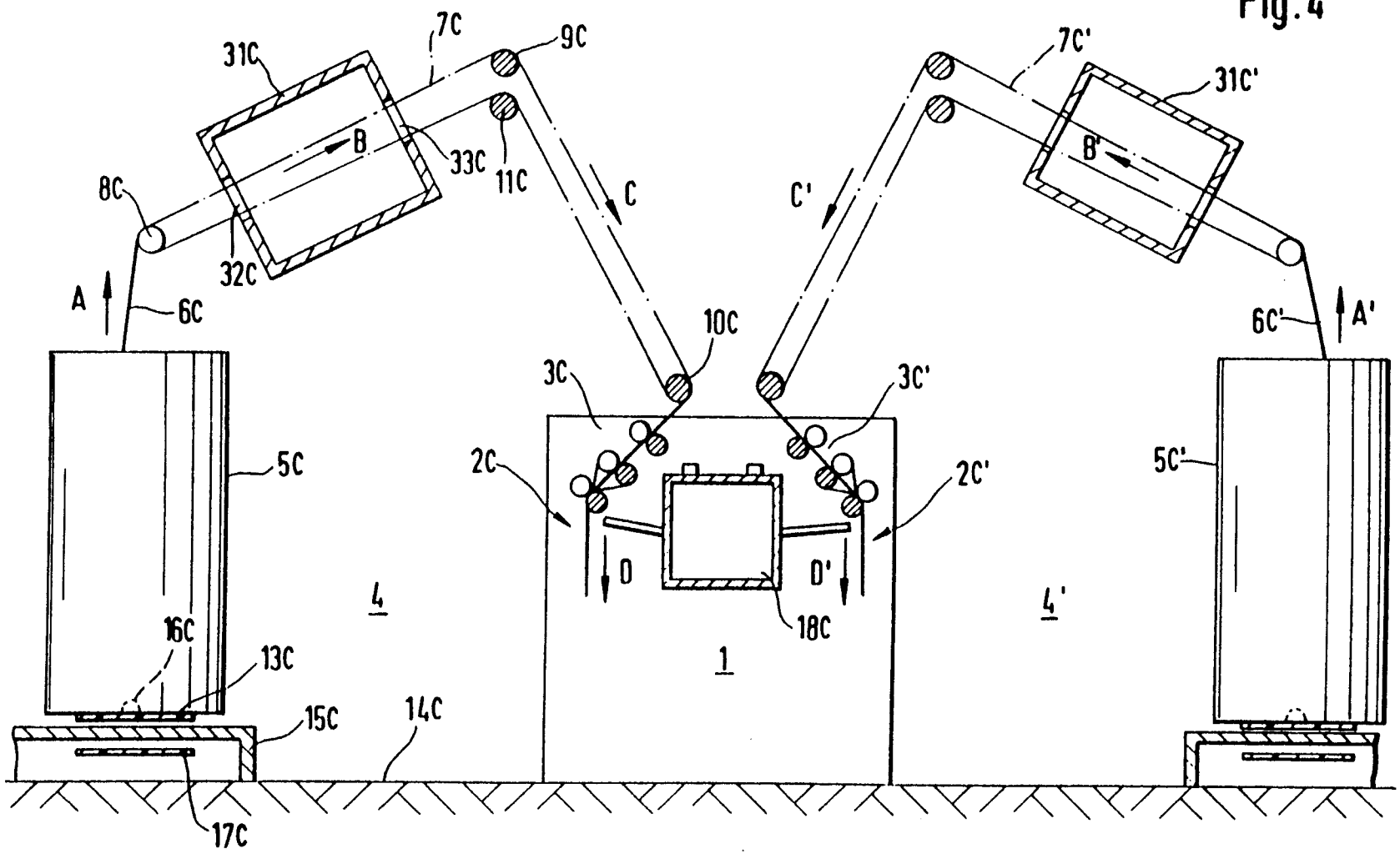
FIG. 4 is a partial cross-sectional view of a machine according to the invention, in which case two air-conditioning ducts are provided which extend in the longitudinal direction of the machine and through which transports belts are guided together with the slivers transported by them.

In the case of the embodiment according to FIG. 4, one air-conditioning duct 31C, 31C' is assigned to each side of the machine through which the transport belts 7C, 7C' are guided. The inlet 32C and the outlet 33C to these air-conditioning ducts 31C, 31C' is sealed off as well as possible. In this case, it may be provided as a deviation from the shown embodiment that only the upper run of the transport belts 7C, 7C', which guides the slivers 6C, 6C', runs through the air-conditioning duct 31C, 31C'. Since these transport belts 7C, 7C' are covered by means of sliding guides, a relatively good sealing can be achieved. In order to nevertheless allow the sliding guides a good air access to the slivers 6C, 6C', it is provided in this embodiment, as in most of the other embodiments, that the sliding guides and/or transport belts 7C, 7C' are air-permeable, in that they are, for example, provided with perforations or the like.

Figure 5:
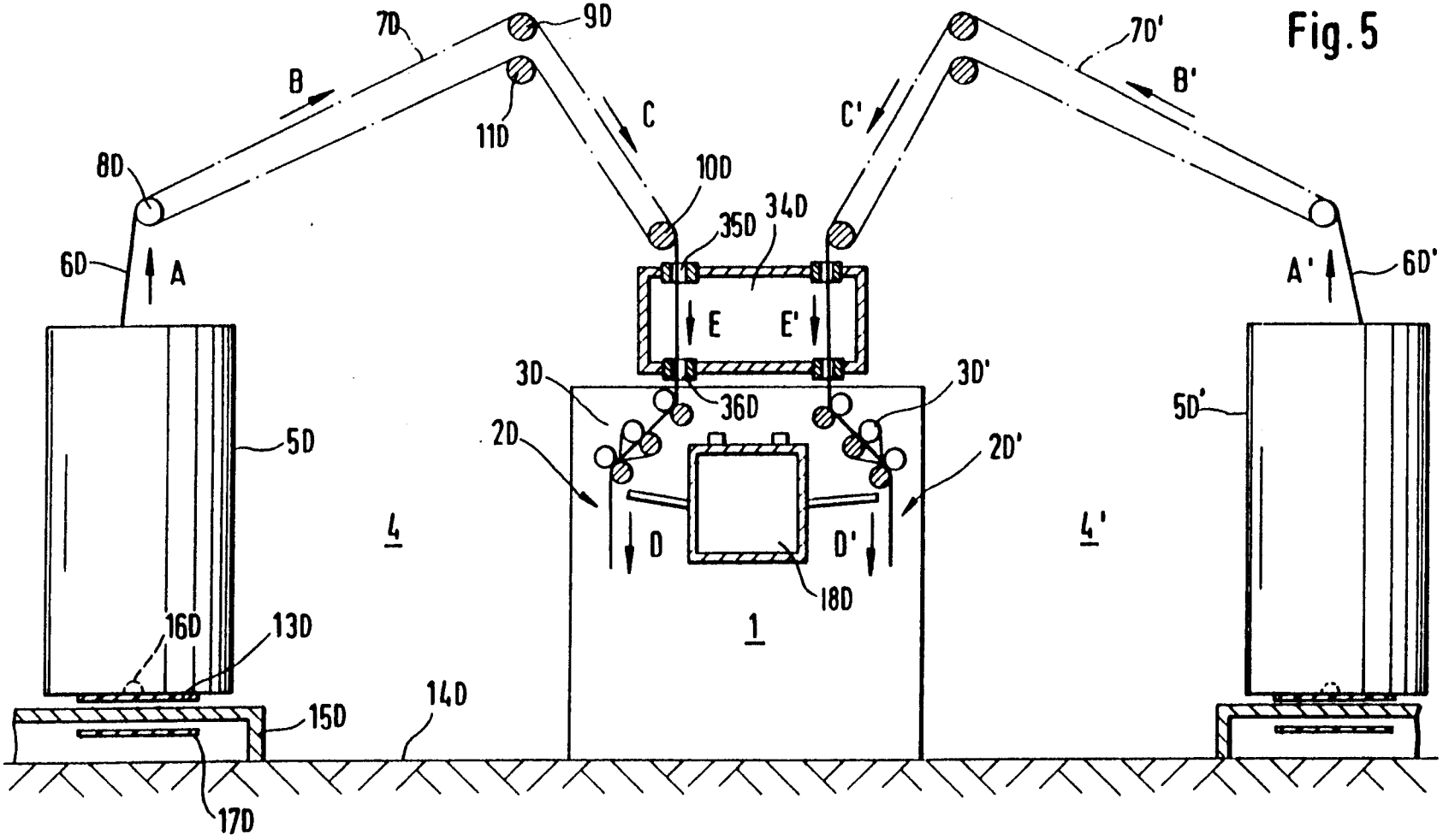
FIG. 5 is a partial cross-sectional view of a machine according to the invention, with an air-conditioning duct which is arranged in the area of the machine center and between the end of the transport devices and the spinning stations and through which the slivers travel alone.

In the embodiment according to FIG. 5, a central air-conditioning duct 34D, which extends through in the longitudinal direction of the machine, is provided above the spinning machine 1D. The transport belts 7D, 7D' end above this air-conditioning duct 34D. The slivers 6D, 6D' travel alone through this air-conditioning duct 34 in the direction of the arrows (E, E'). The inlet opening 35D and the outlet opening 36D are designed as sliver guides in such a manner that the air-conditioning duct 34D is sealed off relatively well toward the outside.

Figure 6:
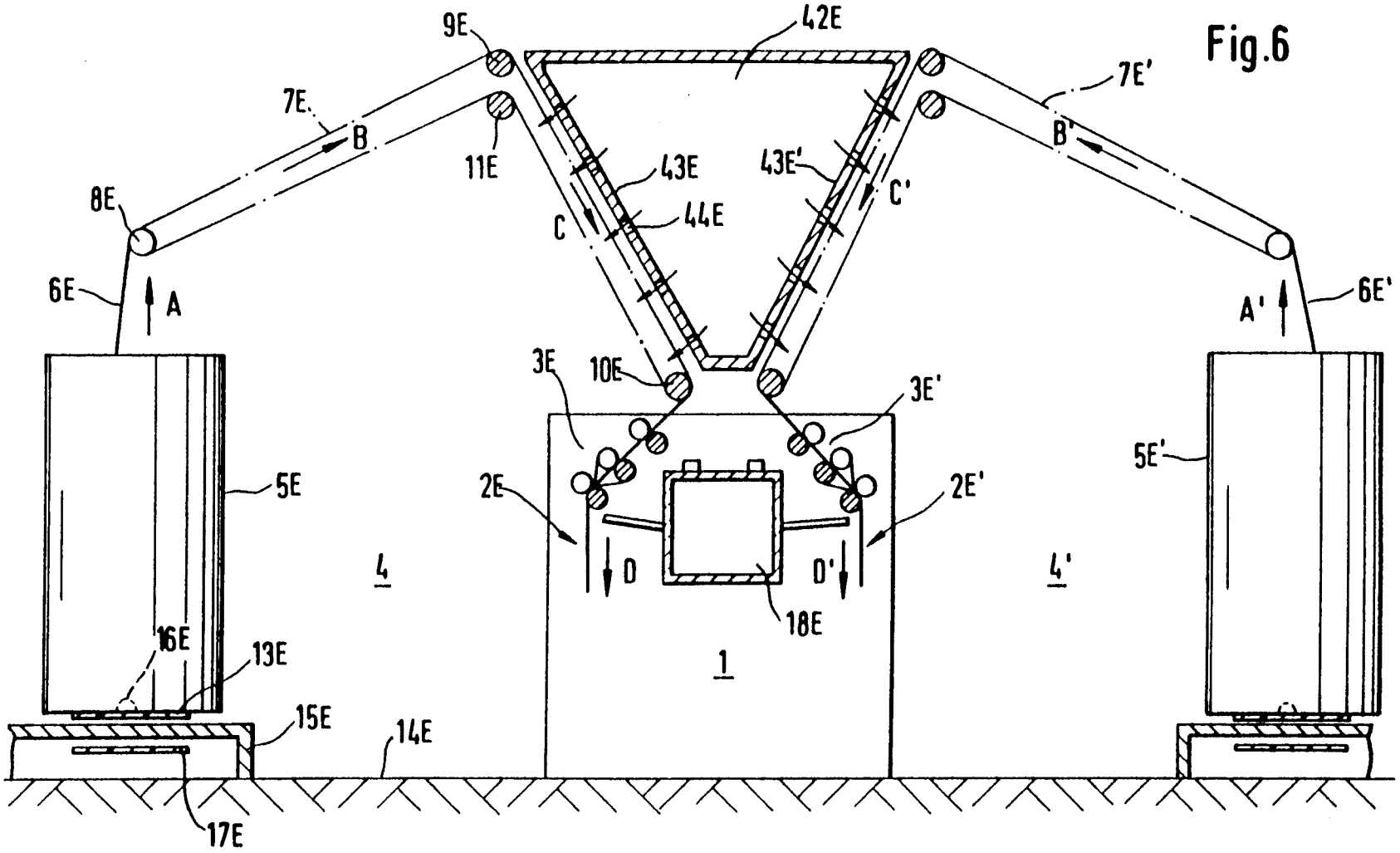
FIG. 6 is a partial cross-sectional view of a spinning machine, with a central air-conditioning duct extending in the longitudinal direction of the machine which, by means of air outlet openings, is directed toward the transport devices which are part of both sides of the machine.

In the embodiment according to FIG. 6, a central air-conditioning duct 42E, which is arranged above the machine center, is also provided. This air-conditioning duct, which has an approximately triangular cross-section, in the area of its walls 43E, 43E' extending in parallel to the sections of the transport belts 7E, 7E' leading diagonally downward, has air outlet openings 44E, by means of which air-conditioned air is supplied to the slivers 6E, 6E'.

Figure 7:
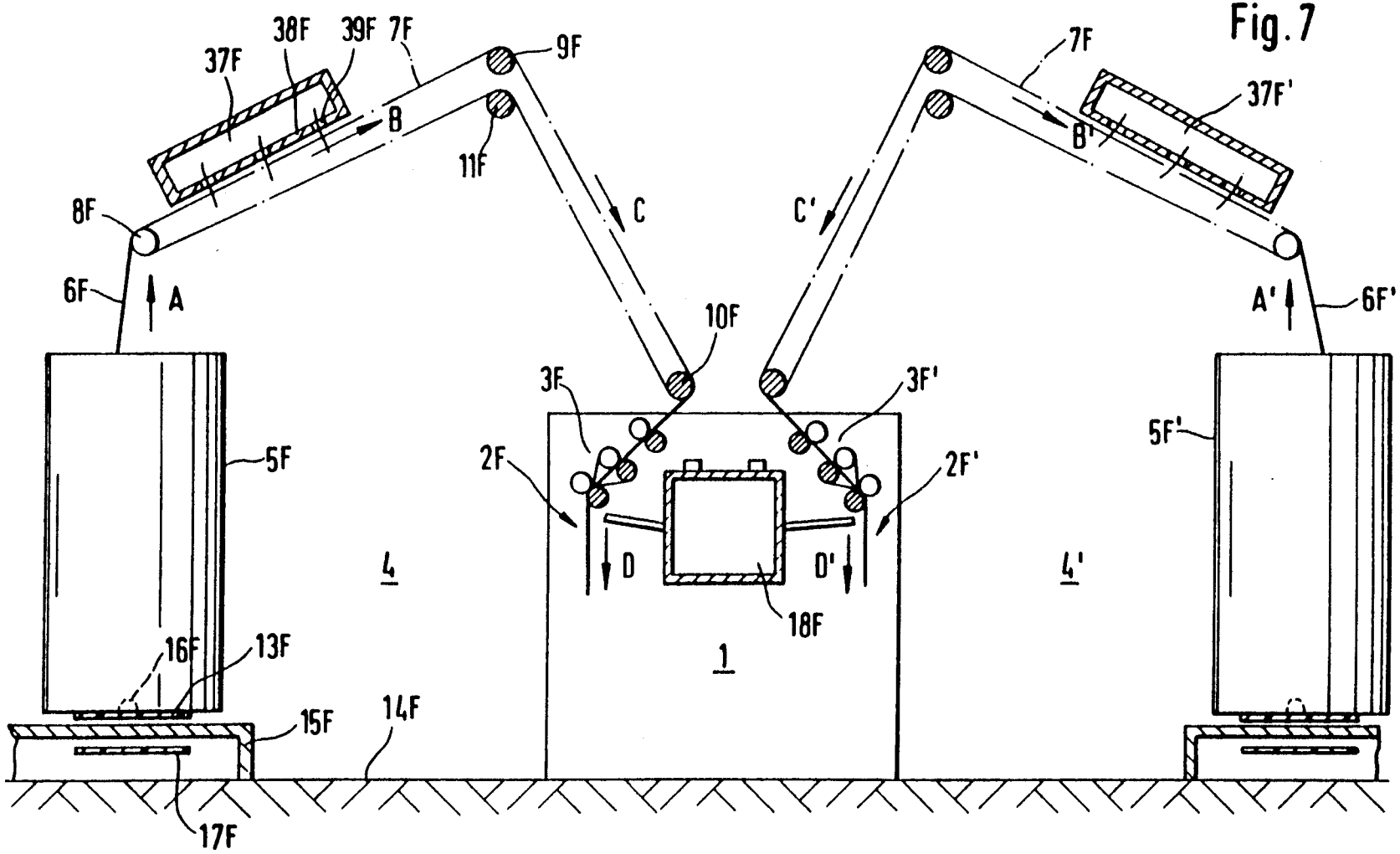
FIG. 7 is a partial cross-sectional view of a spinning machine according to the invention, with two air-conditioning ducts which are arranged above the transport devices and which are equipped with air outlet openings directed toward the transport devices.

In the embodiment according to FIG. 7, two air-conditioning ducts 37F, 37F' are provided which extend in the longitudinal direction of the machine and are constructed as a type of nozzle strips. These air-conditioning ducts 37F, 37F' arranged above the diagonally upwardly extending sections of the transport belts 7F, 7F' have perforations 39F, which serve as air outlet openings, in their wall 38F facing the transport belts 7F, 7F'. Under certain circumstances, it is possible to do without any sliding guides in this section of the transport belts 7F, 7F' which is guided upward with a relatively flat slope so that the air-conditioning ducts 37F, 37F' can take over their function at least partially.

Figure 8:
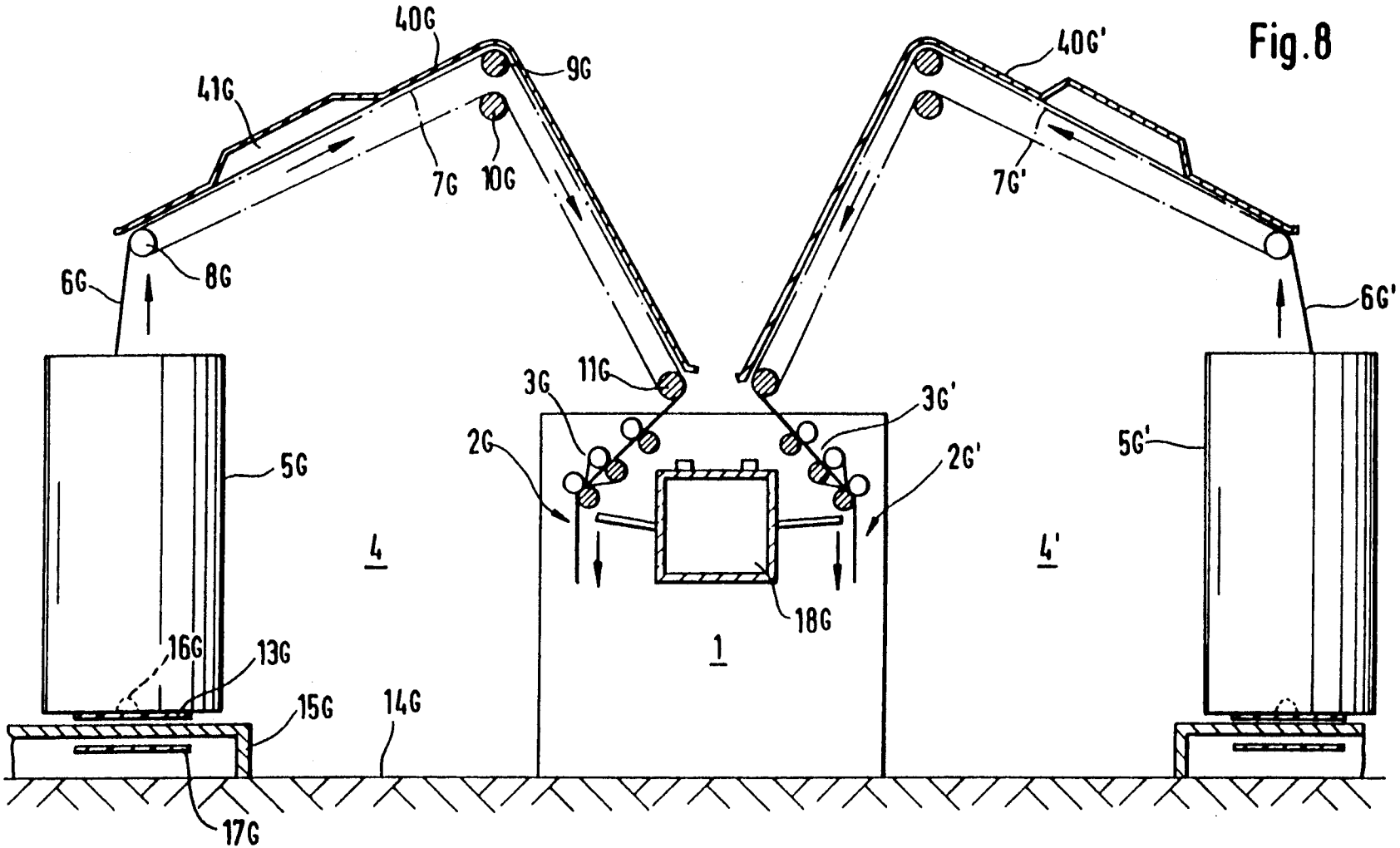
FIG. 8 is a partial cross-sectional view of a spinning machine according to the invention, in which sliding guides are assigned to the transport belts which have a chamber-type widening which can be supplied with air-conditioned air.

In the embodiment according to FIG. 8, the transport belts 7G, 7G' are covered by skids 40G, 40G' which rest slightly on the slivers 6G, 6G' to be transported or are arranged at a distance from them. In the diagonally upwardly extending section, the skids 40G are provided with a widening 41G. Such a widening does not cause any damage particularly in this area which has a relatively flat slope. In a manner not shown in detail, this widening 41G is provided with one or several connections for an air-conditioning system so that the widening can be supplied with air-conditioned air and serves as a type of climatic chamber.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed:

1. A spinning machine comprising a plurality of spinning stations, each said spinning station having a drafting unit and supplied with silver from a silver-containing can, comprising:

transport devices that transport silvers from the silver-containing cans to the drafting units, the transport devices containing transport belts on which the slivers are transported, wherein the slivers are driven between the cans and the drafting unit at each point by a single transport belt without a facing movable belt;

at least one duct for supplying air-conditioned air, said duct extending in a longitudinal direction of the spinning machine and supplying the air-conditioned air to a plurality of spinning stations;

wherein the air-conditioned air is supplied to the slivers in an area between the sliver-containing cans and the drafting units, the slivers being at least partially exposed to the air-conditioned air when on the transport belts during the transport of the slivers to the spinning stations.

2. A spinning machine according to claim 1, wherein the duct is provided with air outlet openings aimed at the slivers situated on the transport belts.

3. A spinning machine according to claim 2, wherein a suction duct for the taking-in of the air supplied by the at least one air-conditioning duct is provided which extends in the longitudinal direction of the machine.

4. A spinning machine according to claim 3, wherein the transport belts are arranged at least partially inside air ducts which are open toward depositing sites of the cans and toward the spinning stations and to which air ducts the air outlet openings of the air-conditioning duct or ducts are connected.

5. A spinning machine according to claim 4, wherein sliding guides for the holding of the slivers on the transport belts are provided, and wherein the sliding guides and/or the transport belts are constructed to be at least partially air-permeable by perforations.

6. A spinning machine according to claim 2, wherein the transport belts are arranged at least partially inside air ducts which are open toward depositing sites of the cans and toward the spinning stations and to which air ducts the air outlet openings of the air-conditioning duct or ducts are connected.

7. A spinning machine according to claim 2, wherein sliding guides for the holding of the slivers on the transport belts are provided, and wherein the sliding guides and/or the transport belts are constructed to be at least partially air-permeable by perforations.

8. A spinning machine according to claim 1, wherein sliding guides for the holding of the slivers on the transport belts are provided, and wherein the sliding guides and/or the transport belts are constructed to be at least partially air-permeable by perforations.

9. A spinning machine according to claim 8, wherein sliding guides are assigned to the transport belts and are provided on at least one point with a chamber-type widening which can be supplied with air-conditioned air.

10. A spinning machine according to claim 1, wherein sliding guides are assigned to the transport belts and are provided on at least one point with a chamber-type widening which can be supplied with air-conditioned air.

11. A spinning machine according to claim 1, wherein the spinning stations are arranged adjacent one another in a row, and two rows of the spinning stations are arranged side-by-side, with at least one respective row of sliver containing cans for each row of spinning stations, said rows of cans being disposed laterally outwardly of the spinning stations at opposite sides of the spinning machine.

12. A spinning machine according to claim 11, further comprising:

a longitudinally extending air-conditioning duct for each row of spinning stations, and respective branch air-conditioning ducts along the sliver transport belts for the respective rows of spinning stations and connecting to the pertaining one of the longitudinally extending air-conditioning ducts.

13. A spinning machine according to claim 12, wherein the sliver transport belts travel through respective branch air-conditioning ducts.

14. A spinning machine according to claim 13, wherein said longitudinally extending air-conditioning ducts open into the branch air-conditioning ducts at a location adjacent the cans.

15. A spinning machine according to claim 13, wherein said longitudinally extending air-conditioning ducts open into the branch air-conditioning ducts at a location adjacent a mid path deflection region of the transport path of the transport belts.

16. A spinning machine according to claim 11, wherein the air-conditioning duct extends transversely of a travel path of the slivers along a central area of the machine with respective ones of the transport belts passing through the air-conditioning duct over a small portion of the sliver travel path thereof.

17. A spinning machine according to claim 11, further comprising a second duct for supplying air-conditioned air and parallel to the longitudinally extending air-conditioning duct, with one said air-conditioning duct at each side of the machine, which air-conditioning ducts have openings for air-conditioning air flow outwardly against a portion of the travel path of the slivers.

18. A spinning machine according to claim 11, wherein the duct is a centrally disposed longitudinally extending air-conditioning duct which has openings in tow of its walls which face a portion of a respective sliver transport travel path for the spinning stations at respective opposite sides of the machine.

19. A spinning machine according to claim 11, wherein the respective transport belts have associated sliver pressing skids.

20. A spinning machine according to claim 19, wherein the air-conditioning ducts are formed by respective outwardly bent sections of the skids.

* * * * *